US007147820B2

(12) United States Patent
Hinzpeter et al.

(10) Patent No.: US 7,147,820 B2
(45) Date of Patent: Dec. 12, 2006

(54) METHOD AND APPARATUS FOR MINIMIZING THE SPREAD OF MAXIMUM COMPRESSION FORCES IN A POWDER PRESS

(75) Inventors: Jurgen Hinzpeter, Schwarzenbek (DE); Ulrich Zeuschner, Schwarzenbek (DE); Ingo Schmidt, Schwarzenbek (DE); Thomas Pannewitz, Schwarzenbek (DE); Udo Baltruschat, Hamburg (DE); Thorsten Ehrich, Hamburg (DE); Ulf Hauschild, Schwarzenbek (DE)

(73) Assignee: Fette GmbH, Schwarzenbek (DE)

( * ) Notice: Subject to any disclaimer, the term of this patent is extended or adjusted under 35 U.S.C. 154(b) by 456 days.

(21) Appl. No.: 10/225,604

(22) Filed: Aug. 22, 2002

(65) Prior Publication Data

US 2003/0047089 A1 Mar. 13, 2003

(30) Foreign Application Priority Data

Aug. 31, 2001 (DE) ..... 101 42 623

(51) Int. Cl.
*B22F 3/00* (2006.01)

(52) U.S. Cl. ..... 419/38; 419/66; 425/78

(58) Field of Classification Search ..... 425/78; 419/38, 66

See application file for complete search history.

(56) References Cited

U.S. PATENT DOCUMENTS 2,549,642 A * 4/1951 Seelig ..... 425/78
3,593,366 A * 7/1971 Smith ..... 425/78
3,640,654 A * 2/1972 Smith ..... 425/78
3,730,659 A * 5/1973 Smith et al. ..... 425/78
3,788,787 A * 1/1974 Silbereisen et al. ..... 425/78
3,890,413 A * 6/1975 Peterson ..... 264/40.5

(Continued)

FOREIGN PATENT DOCUMENTS

DE 36 399 18 A1 10/1987

(Continued)

OTHER PUBLICATIONS

Japanese Abstract to Appln No. 04222626—Feed Back Regulating Method In Weight Control for Product of Rotary Tablet Machine, oybkusged Mar. 8, 1994.

*Primary Examiner*—Daniel Jenkins
(74) *Attorney, Agent, or Firm*—Vidas, Arrett & Steinkraus, P.A.

(57) ABSTRACT

A method for minimizing the spread of the maximum compression forces in compacting powder, specifically metallic powder, by means of a powder press which has a die-plate, an upper ram, and at least one lower ram which are associated with a die-bore and are respectively operable by a hydraulic press cylinder, and a charging shoe movable on the die-plate along a predetermined path for filling the die-bore with the powder, wherein the maximum compression force of at least the upper ram is measured upon arrival at a predetermined position, the charging shoe, the die-plate, the upper ram and/or lower ram are vibrated at a predetermined frequency and amplitude during the filling operation and/or at the beginning of the compression procedure and, in addition, the filling time or the course of charging shoe motion in time are predetermined, wherein the frequency distribution of the maximum compression force values is determined at intervals and the standard deviation is determined therefrom for the maximum compression force, the standard deviation is compared to a predetermined value, if desired, and the vibration parameters, the course of motion in time and/or the path of charging shoe travel are varied according to a predetermined program until the standard deviation has reached the predetermined value or a minimum.

3 Claims, 1 Drawing Sheet

$P_{max}$ = Maximum compression force
s = Standard deviation
R = Span

U.S. PATENT DOCUMENTS 3,901,642 A * 8/1975 Urmanov et al. ..... 425/410
4,008,023 A * 2/1977 Wentzell ..... 425/78
4,041,123 A * 8/1977 Lange et al. ..... 264/332
4,240,780 A * 12/1980 Carcey ..... 425/407
4,260,346 A * 4/1981 Anderson et al. ..... 425/78
4,583,966 A * 4/1986 Ocker et al. ..... 493/374
4,946,634 A * 8/1990 Shaner ..... 264/40.5
5,043,111 A * 8/1991 Hinzmann et al. ..... 264/40.5
5,211,964 A * 5/1993 Prytherch et al. ..... 425/140
5,672,363 A * 9/1997 Sagawa et al. ..... 425/3
6,432,158 B1 * 8/2002 Harada et al. ..... 75/245
6,890,168 B1 * 5/2005 Kim ..... 425/78

FOREIGN PATENT DOCUMENTS

DE 197 17 217 C2 12/1999
DE 199 03 417 8/2000
DE 199 55 196 A1 5/2001
JP 363132800 A * 6/1986

* cited by examiner $P_{max}$ = Maximum compression force
s = Standard deviation
R = Span

METHOD AND APPARATUS FOR MINIMIZING THE SPREAD OF MAXIMUM COMPRESSION FORCES IN A POWDER PRESS

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

It is known to compress metallic powder and also powder of other material into compacts with a view to sintering the compact subsequently. It is specifically tools of sintered carbide which are manufactured in the sintering process, e.g. reversible cutting blades for milling. Powder presses operate either as eccentric presses or hydraulic presses. Hydraulic presses are preferred because the hydraulic press cylinders can be controlled better with regard to the pressure and path. In a hydraulic press, an upper press cylinder and a lower press cylinder each are connected to the upper ram and lower ram which are associated with a die-bore. The powder is filled in by means of a charging shoe when the lower ram has been moved into the die-bore. Precise proportioning is accomplished by causing the lower ram to move up by a certain amount subsequently, whereupon any powder projecting beyond the die-plate surface is removed by stripping. Subsequently, the powder is compressed by means of the upper ram, in which process the lower ram may be shifted accordingly.

The factor crucial for the quality of the compact is that the powdered material be as homogeneous as possible in its density. It is known to enhance homogeneity by actuating the charging shoe in a predetermined manner, e.g. using different speeds in the forward and backward strokes. It is further known not to move the charging shoe to and fro only linearly in a single direction, but to overlay this motion by at least one lateral motion. It is further known to cause the charging shoe and the die-plate to oscillate by means of an appropriate vibration device of a predetermined frequency and amplitude to improve the homogeneity of the powder in the die-bore. Finally, it is also imaginable to vibrate the lower and upper rams, particularly during the fill-in procedure and at the beginning of the compression procedure. In case of compacts which are of different width extensions in an axial direction care has to be taken that the rams do not travel against an edge so as to be damaged. This will naturally damage the die-bore, too Hence, it is also known to associate the rams with distance-measuring transducers which ensure that the rams can be moved to predetermined positions.

When compacts are manufactured according to the method described it is further essential for the compacts to exhibit approximately equal densities. This requires that the maximum compression force which is achieved in the end position of the upper ram, for example, should remain as equal as possible. However, the compression force is dependent on different factors. When the filling volume is varied the maximum compression force produced will naturally vary, too. A different compression force will also result when the powder is distributed inhomogeneously.

It is further known to arrange a load cell between the press cylinder and the ram, by which the respective maximum compression force can be recorded. In operation, care has to be taken that if the maximum compression force differs too much from a predetermined value an approximation to the desired compression force be obtained by modifying certain parameters.

BRIEF SUMMARY OF THE INVENTION

It is the object of the invention to provide a method and apparatus for minimizing the spread of maximum compression forces when powder is compacted in powder presses, which can be performed in a fully automatic way.

Naturally, a spread will result for the values of maximum compression forces during manufacture. According to the invention, the distribution frequency of compression force values is determined and a standard deviation thereby is determined from time to time. As is known the standard deviation lies between the inflection points of the Gaussian distribution curve. If the standard deviation determined differs from a predetermined minimal deviation a variation will be made, according to the invention, to at least one changed parameter of the compression process. Thus, for example, changes can be made to the vibration parameters, the distance traversed by the charging shoe, the speed of the charging shoe or the course of speed in time during the forward and backward strokes, etc. Individual parameters or combinations thereof may be varied according to a predetermined program. Since the standard deviation is always ascertained anew and a determination can be made as to whether it decreases it is possible, in this way, to obtain a minimization of the standard deviation. This manner allows to completely automatize the operation of the powder press or the compression process and to achieve a minimization of the standard deviation within the shortest time possible. Thus, it is also possible to achieve a minimization of the standard deviation even if other variations are made to the compression process, e.g. a change of the powdered material, a change of the maximum compression force or the like.

DETAILED DESCRIPTION OF THE DRAWING

FIG. 1 shows a Gaussian distribution curve for the maximum compression force of a powder press.

BRIEF DESCRIPTION OF THE DRAWINGS

An accompanying drawing sheet plots a Gaussian distribution curve for the maximum compression force of a powder press. The mean value of the maximum compression force is indicated by $\bar{X}$, the standard deviation in the inflection point of the distribution curve by s, and the span by R. It is understood that s is minimal to obtain reproducibly uniform compacts. On the other hand, it is impossible to cause the standard deviation to run towards the zero.

The inventive device provides a control unit to control the powder press, which also drives means for vibrating the different components involved in the compression procedure, and to control the drive for the charging shoe and its path in moving on the die-plate. According to the invention, a memory is provided which has stored therein the respective measured maximum compression force values, the respective parameters for operating the charging shoe and/or the frequencies and amplitudes for the vibration device. Further, a computer level is provided which determines the frequency distribution of the maximum compression force values read out of the memory and the standard deviation. Finally, a program level is provided which has stored therein a schema for different parameter values for an operation of the charging shoe and/or the frequencies of the vibration device as well as a predetermined sequence of this data or the combination of this data such that the program level carries out the predetermined changes until the standard deviation reaches a predetermined value or minimum.

Figure 1:
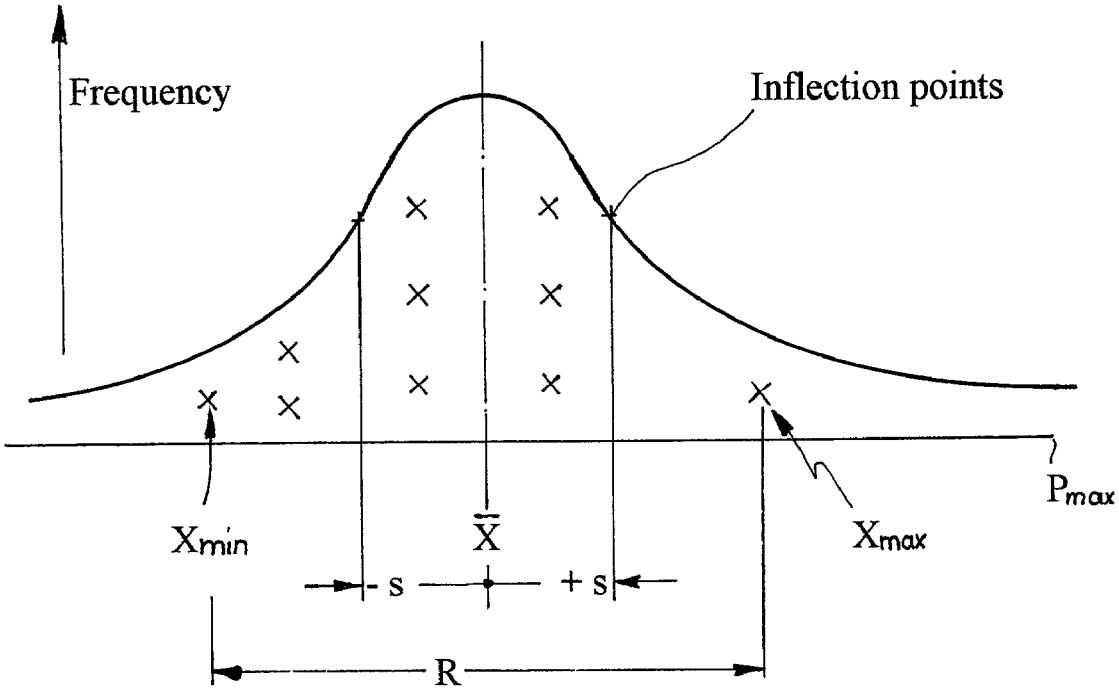

It is understood that variations to certain data will have a larger impact on a variation of the maximum compression force than have others. Therefore, this is taken into account when the various data is "gone through" to influence the standard deviation and, for example, those values which have most influence on the maximum compression force are subjected to a variation first.

The description of the invention only mentioned some parameters of the charging shoe and the vibration device. However, one can imagine even more parameters which take an influence on the filling process or compression procedure and can be varied at random. The invention which has been described intends to incorporate these in a like manner.

The above Examples and disclosure are intended to be illustrative and not exhaustive. These examples and description will suggest many variations and alternatives to one of ordinary skill in this art. All these alternative and variations are intended to be included within the scope of the attached claims. Those familiar with the art may recognize other equivalents to the specific embodiments described herein which equivalents are also intended to be encompassed by the claims attached hereto.

What is claimed is:

1. A method for minimizing the spread of the maximum compression forces in compacting powder, specifically metallic powder, by means of a powder press which has a die-plate, an upper ram, and at least one lower ram which are associated with a die-bore and are respectively operable by a hydraulic press cylinder, and a charging shoe movable on the die-plate along a predetermined path for filling the die-bore with the powder, wherein the maximum compression force of at least the upper ram is measured upon arrival at a predetermined position, the charging shoe, the die-plate, the upper ram and/or lower ram are vibrated at a predetermined frequency and amplitude during the filling operation and/or at the beginning of the compression procedure and, in addition, the filling time or the course of charging shoe motion in time are predetermined, characterized in that the frequency distribution of the maximum compression force values is determined at intervals and the standard deviation is determined therefrom for the maximum compression force, the standard deviation is compared to a predetermined value, if desired, and the vibration parameters, the course of motion in time and/or the path of charging shoe travel are varied according to a program until the standard deviation has reached a minimum value.

2. An apparatus for controlling a powder press which has a die-plate, an upper ram, and at least one lower ram which are associated with a die-bore and are respectively operable by a hydraulic press cylinder, and a charging shoe which is moved by means of a charging-shoe drive on the die-plate along a predetermined path for filling the die-bore with powder, which further has a force-measuring device which measures at least the force at the upper ram, a path-measuring device for at least the upper ram, a vibration device with a variable frequency and amplitude for the charging shoe, the die-plate, the lower ram and/or the upper ram, wherein a control device contains a program which determines the path of the charging shoe, the course of charging shoe motion in time and/or the vibration frequency, characterized in that a memory is provided which has stored therein the respective maximum compression force values, the respective parameters for actuating the charging shoe and/or the frequency and amplitude for the vibration device and a computer level is further provided which determines the frequency distribution of the maximum compression force values read out of the memory and the standard deviation, and compares the standard deviation to a predetermined value, if desired, and a program level is further provided which has stored therein a schema for different parameter for the actuation of the charging shoe and/or the frequency and amplitude of the vibration device, as well as a predetermined sequence of combinations of the stored data such that the program level carries out the predetermined variations until the standard deviation has reached a predetermined value or minimum.

3. A method for minimizing the spread of the maximum compression forces in compacting powder, specifically metallic powder, comprising the steps of:

providing a powder press which has a die-plate, an upper ram, and at least one lower ram which are associated with a die-bore and are respectively operable by a hydraulic press cylinder, and a charging shoe movable on the die-plate along a predetermined path for filling the die-bore with the powder;

measuring the maximum compression force of at least the upper ram upon arrival at a predetermined position;

vibrating the charging shoe, the die-plate, the upper ram and lower ram at a predetermined frequency and amplitude during the filling operation and at the beginning of the compression procedure and the filling time or the course of charging shoe motion in time are predetermined;

determining the frequency distribution of the maximum compression force values, at intervals;

determining the standard deviation therefrom for the maximum compression force;

comparing the standard deviation to a predetermined value, and varying the vibration parameters, the course of motion in time and/or the path of charging shoe travel, according to a program until the standard deviation has reached a minimum value.

* * * * *